US006802259B2

(12) United States Patent
Koch

(10) Patent No.: US 6,802,259 B2
(45) Date of Patent: Oct. 12, 2004

(54) DEVICE FOR FIRING ENERGETIC MATERIALS SUCH AS PYROTECHNICS OR EXPLOSIVES

(75) Inventor: Ernst-Christian Koch, Kaiserslautern (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 10/442,734

(22) Filed: May 21, 2003

(65) Prior Publication Data

US 2003/0226465 A1 Dec. 11, 2003

(30) Foreign Application Priority Data

Jun. 6, 2002 (DE) ..... 102 25 022

(51) Int. Cl.[7] ..... F42B 3/113; C06C 7/00
(52) U.S. Cl. ..... 102/201; 102/202
(58) Field of Search ..... 102/201, 202

(56) References Cited

U.S. PATENT DOCUMENTS 3,235,816 A * 2/1966 Wanlass ..... 372/77
4,455,941 A * 6/1984 Walker et al. ..... 102/275.8
5,052,011 A * 9/1991 Piltch et al. ..... 372/77
5,212,339 A * 5/1993 Piltch ..... 102/202
5,322,019 A * 6/1994 Hyland ..... 102/312
6,460,460 B1 * 10/2002 Jasper et al. ..... 102/201

OTHER PUBLICATIONS

Kentek Corporation, 1996, www.kentek–laser.com.*

Lexel Laser Corporation, Dec. 2003, www.lexellaser.com.*

Lexel Laser Corporation, Dec. 2003, www.lexellaser.com.*

* cited by examiner

*Primary Examiner*—Jack W. Keith
*Assistant Examiner*—James S. Bergin
(74) *Attorney, Agent, or Firm*—Scully, Scott, Murphy & Presser

(57) ABSTRACT

A device for firing energetic materials (14) such as pyrotechnics or explosives, including a firing composition (12) for the energetic materials (14) and an UV-radiation source (16) for irradiating the firing composition (12), wherein the UV-radiation source (6) possesses a piezo-luminescence element (18) in order to provide a current-less and electromagnetically interference-secure firing device.

2 Claims, 1 Drawing Sheet

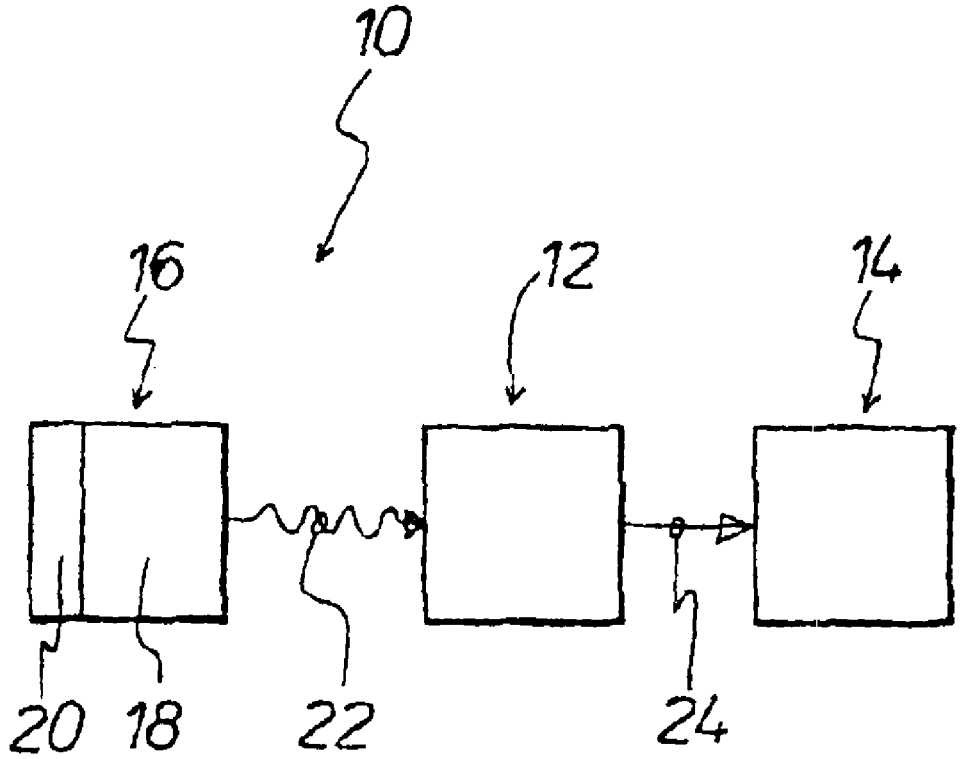
10
16
12
14
20
18
22
24

DEVICE FOR FIRING ENERGETIC MATERIALS SUCH AS PYROTECHNICS OR EXPLOSIVES

BACKGROUND OF THE INVENTION

1. Field of the Invention

The invention concerns a device for firing energetic materials such as pyrotechnics or explosives as comprising a firing composition and an UV-radiation source for irradiating the firing composition.

2. Discussion of the Prior Art

A device of the above-specified kind, which makes use of the photocatalysis effect, has already been proposed by the present inventor. In that case a firing composition which, for example involves a pyrotechnic composition is triggered by exposure to UV-radiation. That triggering effect is based on the presence of photosemiconductors in the pyrotechnic composition, wherein the photosemiconductors, by virtue of their energy band gap, are capable of dividing up halogen-bearing substances contained in the pyrotechnic composition such as, for example, organic binders or inorganic halogen-oxoanions, in such a way that highly reactive halogen atoms are formed. Those halogen atoms are, for example, F-atoms and/or Cl-atoms. Those highly reactive halogen atoms directly oxidize the fuels contained in the firing composition, and thereby trigger the thermal reaction thereof.

The UV-radiation required for triggering the photocatalysis effect is generated by means of suitable current-operated radiation sources. In the case of certain uses, however, that requires an additional UV-unit and its own voltage source so that this known firing arrangement is reserved only for relatively large functional units.

That particular known firing device, in essence, the function of its firing composition, is therefore dependent on a voltage supply, which limits the technical availability thereof.

SUMMARY OF INVENTION

Accordingly, an object of the invention is to provide a device of the kind set forth in the introductory portion of this specification, which is independent of a voltage supply, in effect, say which does not require a voltage supply or any voltage source.

According to the invention the foregoing object is attained in that the UV-radiation source possesses a piezo-luminescence element.

By virtue of the fact that, in the firing device according to the invention, the UV-radiation source possesses a piezo-luminescence element, there is advantageously obtained a current-less firing system which is independent of its own voltage source and which is electromagnetically interference-source, and which is based on the combination of two physical-chemical effects which have heretofore not yet been used for firing or detonating energetic materials, such as pyrotechnics or explosives.

In the firing device according to the invention, the UV-radiation required for the photocatalysis effect for firing the energetic materials is prepared through a solid-state body; in essence, the piezo-luminescence element is preferably formed by a solid-state body which is capable of implementing piezo-luminescence by X-ray-induced disturbance of its crystal lattice. Hereby, this involves the conversion of elastic energy into electromagnetic radiation.

The firing device according to the invention, in effect, the current-less and electromagnetic interference-secure firing system according to the invention, preferably has a pressure pickup or sensor which is connected upstream of the piezo-luminescence element. The piezo-luminescence element is arranged in such a manner that, in the case of elastic deformation thereof, the generated released electromagnetic radiation (UV-radiation) impinges directly against the firing composition which is to be triggered.

The firing device according to the invention evidences the quite significant advantage that, due to the absence of electrically conductive components, there is no possibility of an unintentional triggering of the firing composition by virtue of coupled-in electromagnetic radiation. In addition, the function of the firing element is not dependent upon the function of an electrical voltage supply, so that there is increased the technical availability of the firing element according to the invention. Upon use of using the firing device according to the invention; for example, in a motor vehicle with defective electronics, triggering of safety devices, such as an air bag, side impact protection and the like is nevertheless advantageously guaranteed.

BRIEF DESCRIPTION OF THE ACCOMPANYING DRAWINGS

Further details, features and advantages of the invention will be apparent from the description of an exemplary embodiment, diagrammatically illustrated in the single FIGURE in a block view of the device according for firing energetic materials, such as pyrotechnics or explosives.

DETAILED DESCRIPTION OF A PREFERRED EMBODIMENT

The single FIGURE of the drawing diagrammatically shows an embodiment of the firing device 10 with a firing composition 12 for energetic materials 14 which can relate to pyrotechnics or explosives. Associated with the firing composition 12 is an UV-radiation source 16 which serves for radiating the firing composition 12. The UV-radiation source 16 possesses a piezo-luminescence element 18 with a pressure pickup 20. When the piezo-luminescence element 18 is elastically deformed by means of the pressure pickup 20, UV-radiation is liberated, as is indicated by the wavy arrow 22. The piezo-luminescence 18 is formed by a solid-state body which, by virtue of X-ray-induced disturbance of its crystal lattice, is capable of implementing piezo-luminescence, in effect, causing a conversion of elastic energy into electromagnetic radiation. The UV-radiation indicated by the wavy arrow 22 impinges on the firing composition 12 and triggers it by means of the resultant photocatalysis effect. The firing composition 12 is operatively connected to the energetic materials 14, as is indicated by the arrow 24.

The firing device 10 can also be provided for direct firing of the energetic material 14.

List of References:

10 firing device
12 firing composition (of 10 for 14)
14 energetic materials
16 UV-radiation source (of 10 for 12)
18 piezo-luminescence element (of 16)
20 pressure pickup (for 18)
22 UV-radiation (of 18)
24 operative connection (between 12 and 14)

What is claimed is:

1. A device for firing energetic materials (14) such as pyrotechnics or explosives comprising a firing composition (12) and an UV-radiation source (16) for irradiating the firing composition (12), and wherein the UV-radiation source (16) comprises a piezo-luminescence element (18), said piezo-luminescence element (18) being formed by a solid-state body which is capable of implementing piezo-luminescence by X-ray-induced disturbance of the crystal lattice of said solid-state body.

2. A device according to claim 1, wherein the piezo-luminescence element (18) possesses a pressure pickup (20).

* * * * *